US009352337B2

(12) United States Patent
Lee et al.

(10) Patent No.: US 9,352,337 B2
(45) Date of Patent: May 31, 2016

(54) FIXED ANGLE HYBRID CENTRIFUGE ROTOR HAVING COMPOSITE OUTER PORTION AND PENETRATING INNER PORTION

(75) Inventors: Hak Gu Lee, Changwon-si (KR); Ji Hoon Kim, Changwon-si (KR); Ji Sang Park, Changwon-si (KR); Woo Kyoung Lee, Changwon-si (KR)

(73) Assignee: KOREA INSTITUTE OF MACHINERY & MATERIALS (KR)

( * ) Notice: Subject to any disclaimer, the term of this patent is extended or adjusted under 35 U.S.C. 154(b) by 720 days.

(21) Appl. No.: 13/701,120

(22) PCT Filed: Mar. 19, 2012

(86) PCT No.: PCT/KR2012/001951

§ 371 (c)(1),
(2), (4) Date: Dec. 10, 2012

(87) PCT Pub. No.: WO2013/100259

PCT Pub. Date: Jul. 4, 2013

(65) Prior Publication Data

US 2013/0165311 A1 Jun. 27, 2013

(30) Foreign Application Priority Data

Dec. 27, 2011 (KR) ..... 10-2011-0143516

(51) Int. Cl.
*B04B 7/08* (2006.01)
*B04B 5/04* (2006.01)

(52) U.S. Cl.
CPC ..... *B04B 7/085* (2013.01); *B04B 5/0414* (2013.01)

(58) Field of Classification Search
CPC ..... B04B 7/085; B04B 7/12; B04B 7/08; B04B 5/04; B04B 5/0414
USPC ..... 494/81, 16
See application file for complete search history.

(56) References Cited

U.S. PATENT DOCUMENTS 4,468,269 A * 8/1984 Carey ..... 156/175
4,781,669 A * 11/1988 Piramoon ..... 494/16
4,817,453 A * 4/1989 Breslich et al. ..... 74/572.4
4,824,429 A * 4/1989 Keunen et al. ..... 494/16
5,057,071 A 10/1991 Piramoon
5,363,301 A 11/1994 Takeuchi
5,411,465 A * 5/1995 Glen et al. ..... 494/16
5,643,168 A 7/1997 Piramoon et al.

(Continued)

FOREIGN PATENT DOCUMENTS

EP 0225610 A2 * 6/1987 ..... B04B 7/085
EP 0294138 A2 * 12/1988 ..... B04B 7/085
KR 1020110100345 9/2011

*Primary Examiner* — Charles Cooley
*Assistant Examiner* — Shuyi S Liu
(74) *Attorney, Agent, or Firm* — Brooks Kushman P.C.

(57) ABSTRACT

A fixed angle hybrid centrifuge rotor includes an outer portion of composite material reinforced with fiber at least along a peripheral direction, an inner portion having stiffness less than ⅕ of stiffness of the outer portion and provided with a plurality of slots receiving specimens, and a reinforcer of composite material mounted into the slots of the inner portion, the reinforcer fabricated from material having higher stiffness than that of the inner portion and reinforced with fiber along at least peripheral direction of the slot. The reinforcer penetrates the inner portion and at least a part of the reinforcer downwardly protrudes from the inner portion. The rotor can rotate at a high speed and provides improved safety.

20 Claims, 10 Drawing Sheets

(56) References Cited

U.S. PATENT DOCUMENTS 5,759,592 A 6/1998 Piramoon et al.
5,776,400 A 7/1998 Piramoon et al.
2010/0298108 A1* 11/2010 Sherman et al. ..... 494/20

* cited by examiner

FIG.4
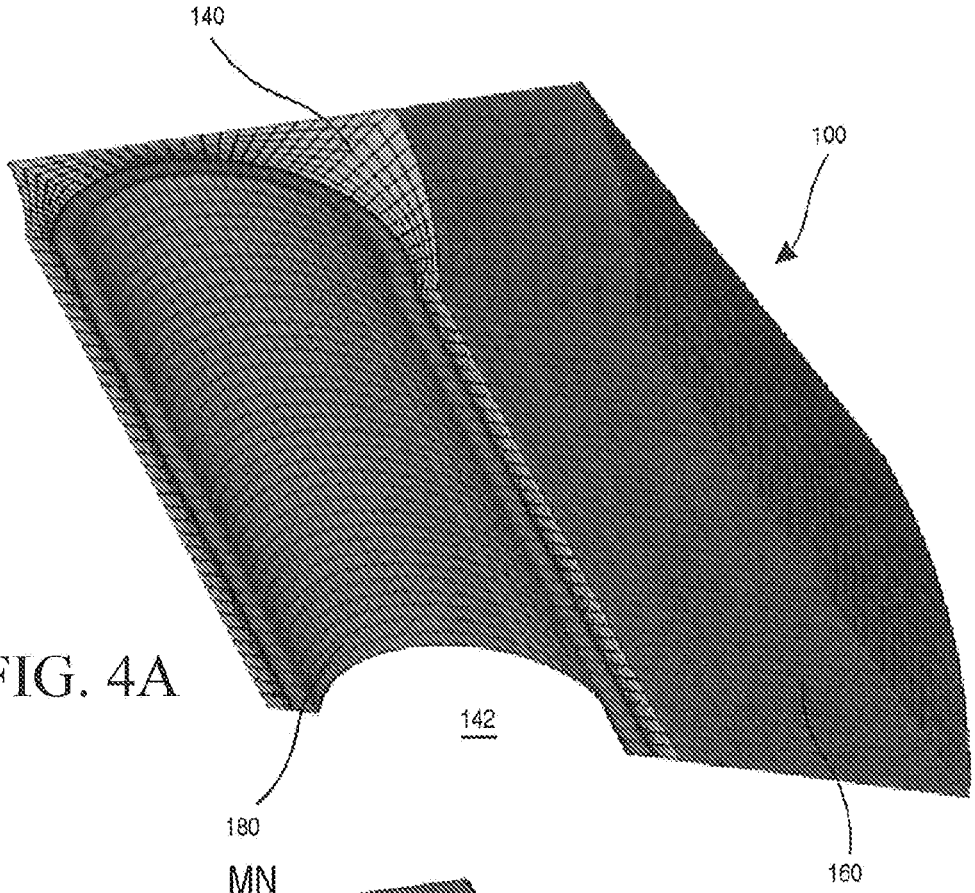
FIG. 4A
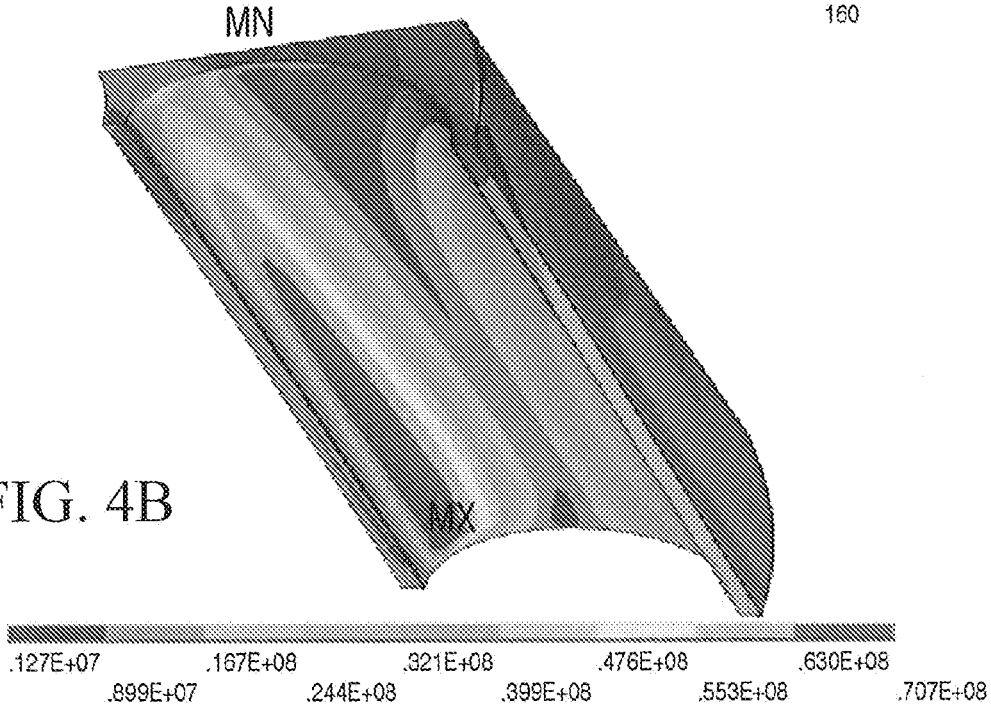
FIG. 4B

FIXED ANGLE HYBRID CENTRIFUGE ROTOR HAVING COMPOSITE OUTER PORTION AND PENETRATING INNER PORTION

CROSS-REFERENCE TO RELATED APPLICATION

This application is the U.S. national phase of PCT Appln. No. PCT/KR2012/001951 filed Mar. 19, 2012 which claims priority to Korean Application No. KR 10-2011-0143516 filed Dec. 27, 2011, the disclosures of which are incorporated in their entirety by reference herein.

TECHNICAL FIELD

This invention relates to a fixed angle hybrid centrifuge rotor. This invention relates more particularly to a fixed angle hybrid centrifuge rotor comprising; an outer portion of composite material reinforced with fiber at least along a peripheral direction, an inner portion having stiffness less than ⅕ of stiffness of the outer portion and being provided with a plurality of slots receiving specimens, and a reinforcer of composite material which is mounted into the slots of the inner portion, the reinforcer being fabricated from material having higher stiffness than that of the inner portion and reinforced with fiber along at least peripheral direction of the slot, wherein the reinforcer penetrates the inner portion and at least a part of the reinforcer downwardly protrudes from the inner portion. In the rotor of the present invention, each stress distribution generated along θ and r directions in the rotor is harmonized with anisotropy of strength in material by regulating a stiffness ratio between the inner portion and the outer portion, and stress concentration generated in the inner portion is decreased by the reinforcer which penetrates the inner portion and at least a part of the reinforcer downwardly protrudes from the inner portion. Therefore, the rotor of the present invention can rotate at a higher speed.

BACKGROUND

A centrifuge is a piece of equipment for rotating a specimen at a high speed. Such high speed rotation generates a centrifugal force and causes denser substances of the specimen to separate out along the radial direction. The centrifuge is employed in the areas of biology, physics, medicine, chemistry, etc.

The centrifuge includes a rotor driven by a motor and rotating at a high speed. There are various types of rotors including vertical rotors, hanging rotors, fixed angle rotors, etc.

The subject of this patent application is a fixed angle rotor, which comprises a plurality of slot radially placed around a center of rotation center and slanted at a certain angle. The slots receive a tube containing a specimen and may have a various of sizes and positions in the rotor depending on their application fields. The slots are rotated at a high speed and, therefore, a high centrifugal force is generated, which causes the substances of the specimen to be separated based on their density.

Such high speed rotation generates a stress distribution according to a centrifugal force in the rotor as well as the specimen. The centrifugal force per unit volume is proportional to the square of rotational speed, distance and density. As a result, if the rotor is fabricated from materials having high specific strength, that is, having low density and high strength, it can rotate at a higher speed. Therefore, various attempts are tried to increase the rotational speed of the rotor by employing composite materials, which generally have high specific strength.

Based on the position of use of composite materials, conventional composite material centrifuge rotors may be classified as three types, a metal inner portion—a composite material outer portion, a polymer inner portion—a composite material outer portion, and a composite material inner portion—a composite material outer portion.

U.S. Pat. No. 5,057,071 discloses a centrifuge rotor including an aluminum inner portion and a composite material outer portion. U.S. Pat. No. 4,824,429 discloses a centrifuge rotor including a polymer inner portion and a composite material outer portion. However, the latter has the problem that stress concentration is generated around the slots of the polymer inner portion. U.S. Pat. Nos. 5,643,168, 5,759,592, 5,776,400 and 5,362,301 disclose a rotor including a composite material inner portion and outer portion. KR application no. 10-2010-0019254 discloses a light weight fixed angle hybrid centrifuge rotor.

When a rotor includes a composite material inner portion and outer portion, as obviously described in each of the above patents, the inner portion is reinforced with fiber along a radial direction (r) and the outer portion is reinforced with fiber along a peripheral direction (θ). In other words, even though various arrangements comprising a quasi-isotropic, random, or weaving arrangement are employed in the inner portion, the inner portion is basically formed by stacking such various arrangements in r and θ planes along the axial direction, that is, the vertical direction (z-direction) of a circular cylindrical coordinate system, and the outer portion surrounds the inner portion by arranging fiber along the peripheral direction (θ).

The basic principle of such a structure is such that the expansion of a rotor, which is generated when the rotor rotates at a high speed, is suppressed by reinforcing the inner portion with fiber along the radial direction and the outer portion with fiber along the peripheral direction.

As shown in FIG. 1, stress concentration is generated around slots, which causes serious problems when designing a centrifuge rotor. Taking a symmetrical distribution of the slots into consideration, stress analysis about only one slot was performed. The result of the stress analysis shown in FIG. 1 indicates that stress is concentrated around the slot along the radius and peripheral directions.

In a way to relieve such stress concentration, as shown in FIG. 3, conventional centrifuge rotors employ a reinforcer of composite material inserted into a slot, in which fiber is arranged along the peripheral direction of the slot mainly. FIG. 2 shows Von Mises stress distributions in an isotropic inner portion depending on the presence or not of the reinforcer, and indicates that the maximum stress around the slot decreases by 37%.

In the case of the conventional rotors described above, the reinforcer of composite material surrounded by the inner portion has an effect to decrease the stress concentration generated in the rotors. However, since such decrease is not sufficient, the reinforcer and parts of the inner portion around slots still remain as fragile parts.

SUMMARY

A purpose of the present invention is to provide a fixed angle hybrid centrifuge rotor comprising an outer portion reinforced with fiber along its peripheral direction and an inner portion being provided with a plurality of slots, which can rotate at a higher speed by minimizing a stress concentration phenomenon in the centrifuge rotor.

In accordance with the present invention, there is provided a fixed angle hybrid centrifuge rotor comprising; an outer portion of composite material reinforced with fiber at least along a peripheral direction, an inner portion having stiffness less than ⅕ of stiffness of the outer portion and being provided with a plurality of slots receiving specimens, and a reinforcer of composite material which is mounted into the slots of the inner portion, the reinforcer being fabricated from material having higher stiffness than that of the inner portion and reinforced with fiber along at least peripheral direction of the slot, wherein the reinforcer penetrates the inner portion and at least a part of the reinforcer downwardly protrudes from the inner portion. The inner diameter of the outer portion may be smaller than the outer diameter of the inner portion and, therefore, the inner portion may be forcefully inserted into the outer portion.

In accordance with the present invention, there is further provided a fixed angle hybrid centrifuge rotor comprising; an outer portion of composite material reinforced with fiber at least along a peripheral direction, an inner portion having stiffness less than ⅕ of stiffness of the outer portion and being provided with a plurality of slots receiving specimens, a hub having higher stiffness than that of the inner part and an external diameter larger than the inner diameter of the inner portion, wherein the hub is mounted into the inner portion such that it pressures the inner portion from the inside of the inner portion in a state of mounting, and a reinforcer of composite material which is mounted into the slots of the inner portion, the reinforcer being fabricated from material having higher stiffness than that of the inner portion and reinforced with fiber along at least peripheral direction of the slot, wherein the reinforcer penetrates the inner portion and at least a part of the reinforcer downwardly protrudes from the inner portion.

In accordance with the present invention, there is further provided a fixed angle hybrid centrifuge rotor comprising; an outer portion of composite material reinforced with fiber at least along a peripheral direction, an inner portion having stiffness less than ⅕ of stiffness of the outer portion and being provided with a plurality of slots receiving specimens, a hub having higher stiffness than that of the inner part and an external diameter larger than the inner diameter of the inner portion, wherein the hub is mounted into the inner portion such that it pressures the inner portion from the inside of the inner portion in a state of mounting, a connecting member connected into one side of the hub so as to make the hub pressure the inner portion in a state of connection, and a reinforcer of composite material which is mounted into the slots of the inner portion, the reinforcer being fabricated from material having higher stiffness than that of the inner portion and reinforced with fiber along at least peripheral direction of the slot, wherein the reinforcer penetrates the inner portion and at least a part of the reinforcer downwardly protrudes from the inner portion.

In accordance with the present invention, there is further provided a fixed angle hybrid centrifuge rotor comprising; an outer portion of composite material reinforced with fiber at least along a peripheral direction, an inner portion having stiffness less than ⅕ of stiffness of the outer portion and being provided with a plurality of slots receiving specimens, a connecting portion having higher stiffness than that of the inner portion, wherein the connecting portion is mounted on at least the upper part of the inner portion and connected to a driving shaft, and is open at parts contacted with the slots of the inner portion, and a reinforcer of composite material which is mounted into the slots of the inner portion, the reinforcer being fabricated from material having higher stiffness than that of the inner portion and reinforced with fiber along at least peripheral direction of the slot, wherein the reinforcer penetrates the inner portion and at least a part of the reinforcer downwardly protrudes from the inner portion.

According to the present invention, the inner portion has stiffness less than ⅕ of stiffness of the outer portion, and the reinforcer downwardly penetrates the inner portion and at least a part of the reinforcer protrudes from the inner portion. Such changes in the inner portion and the reinforcer cause stress concentration generated in the inner portion to decrease drastically. Especially, regulating a stiffness ratio between the inner portion including a plurality of slots and the outer portion surrounding the inner portion causes stress concentration along the radial direction of the outer portion and the radial and peripheral direction of the inner portion to decrease, and stress concentration along the peripheral direction of the outer portion to increase, wherein the outer portion fabricated from composite material has the highest strength along the peripheral direction of the outer portion.

Further, especially in a large size rotor, in order to solve the problem that spacing from the driving axis widens due to deterioration of stiffness of the inner portion, the hub with high stiffness is designed to generate a compressive force against the inner diameter of the inner portion, and the connecting member having higher stiffness than that of the inner portion is mounted on at least the upper part of the inner portion and connected to the driving shaft.

Since such features of the present invention make it possible to optimally design a centrifuge rotor in which anisotropy of strength in composite materials is taken into consideration, it is possible to obtain a light weight fixed angle centrifuge rotor which can rotate at a higher speed.

BRIEF DESCRIPTION OF THE DRAWINGS

FIGS. 4A and 4B are graphs showing a stress distribution analysis model wherein slanting of a conventional fixed angle centrifuge rotor is taken into consideration, and analysis results.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Referring to FIGS. 2 to 6, the experimental results to support the concept of the present invention are explained.

Figure 2A:
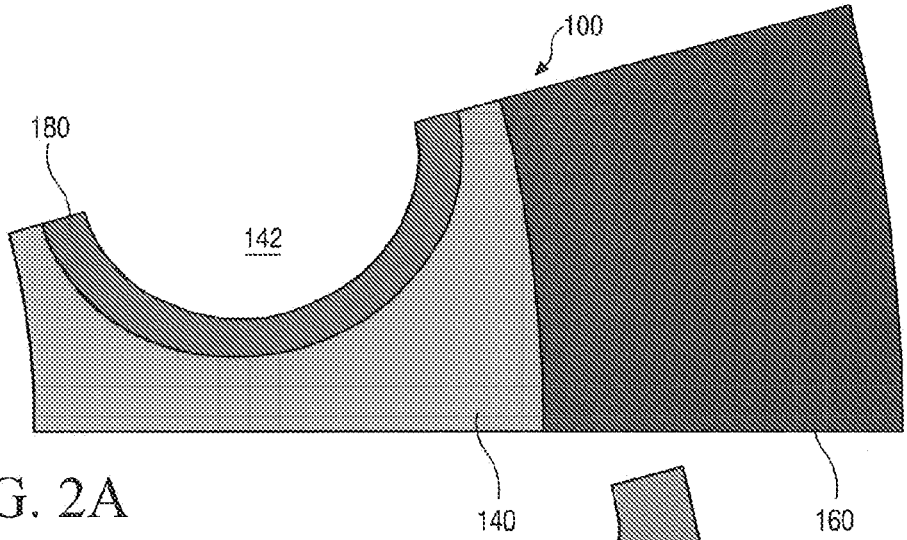
FIGS. 2A-2C are graphs showing differences in stress concentration depending on the presence or not of a reinforcer of composite material in a conventional hybrid centrifuge rotor, when composite material is employed in an outer portion of the rotor.
Figure 2B:
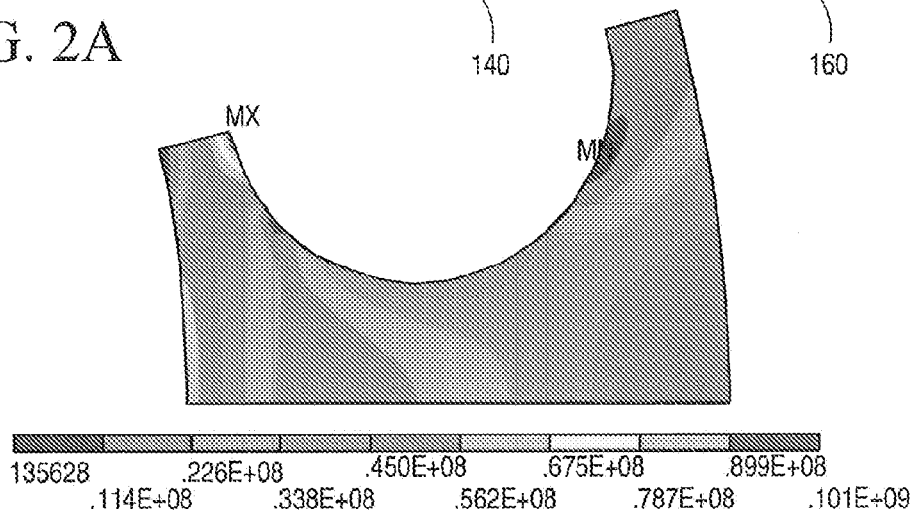
Figure 2C:
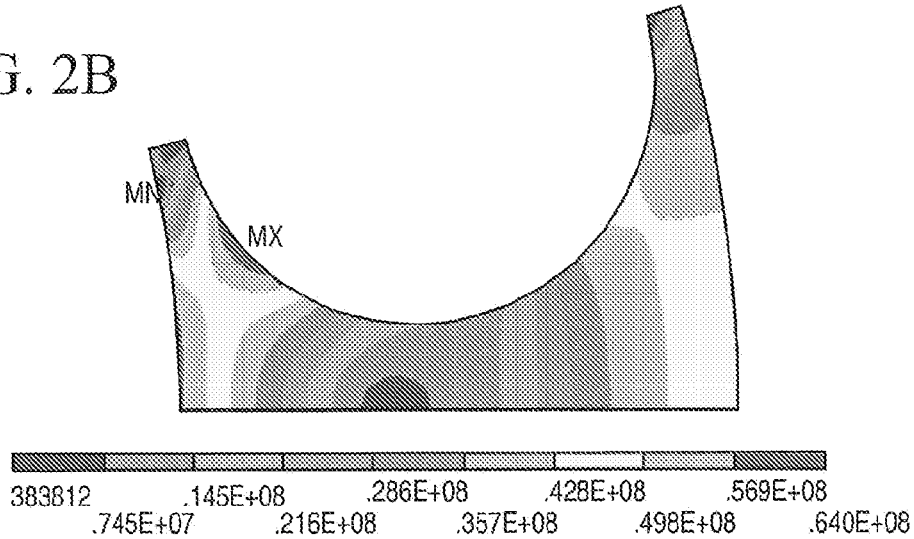
Figure 3A:
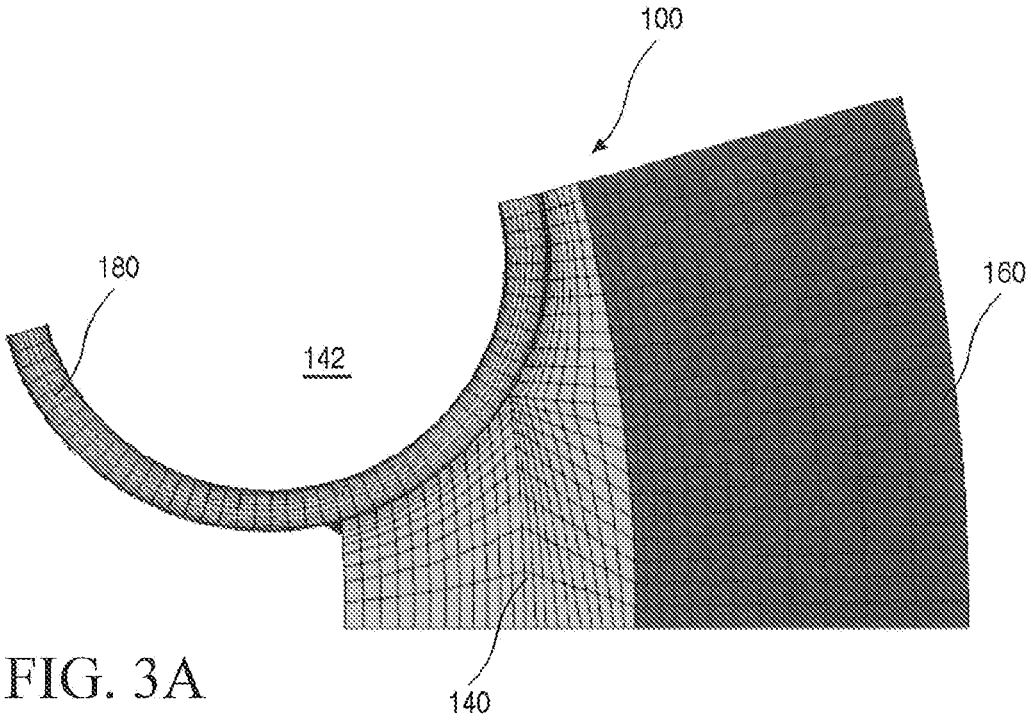
FIGS. 3A and 3B are graphs showing a more effective decrease in stress concentration obtained by removing a functionally unnecessary part of an inner portion according to the present invention.
Figure 3B:
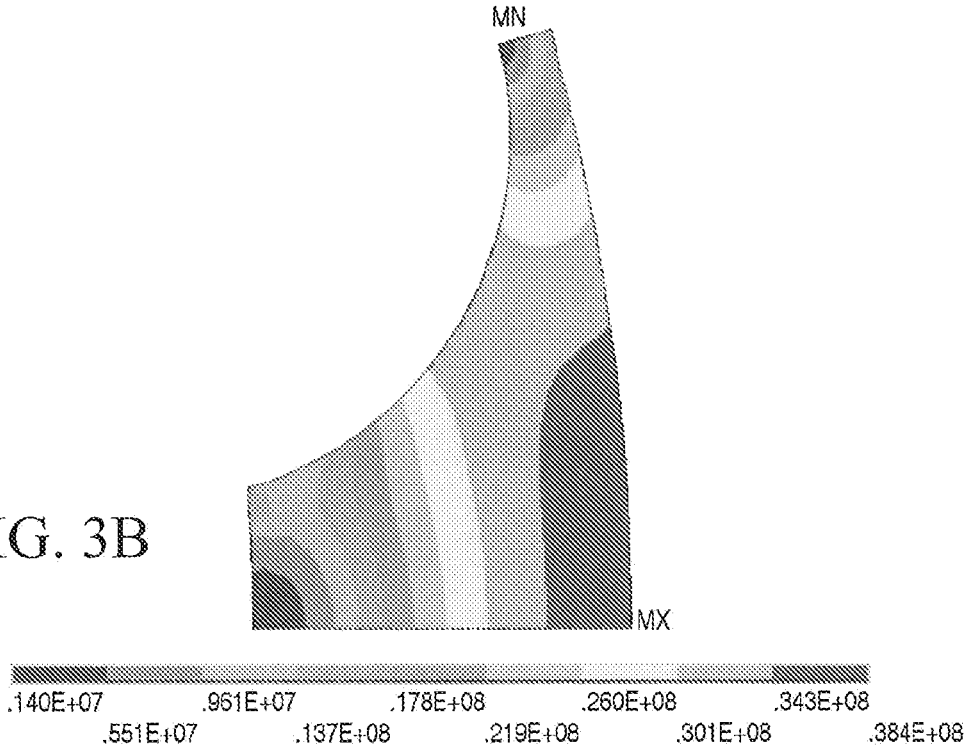
Figure 5A:
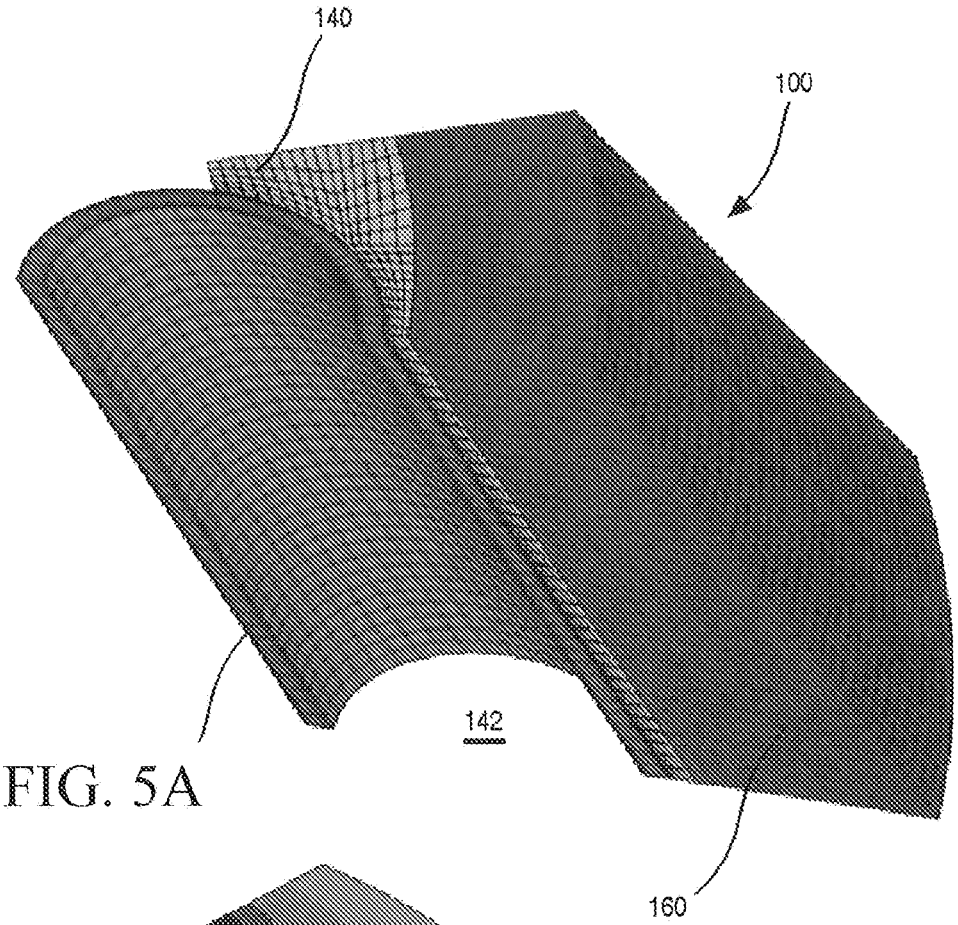
FIGS. 5A and 5B are graphs showing a stress distribution analysis model wherein slanting of a hybrid rotor of the present invention us taken into consideration, and analysis results.
Figure 5B:
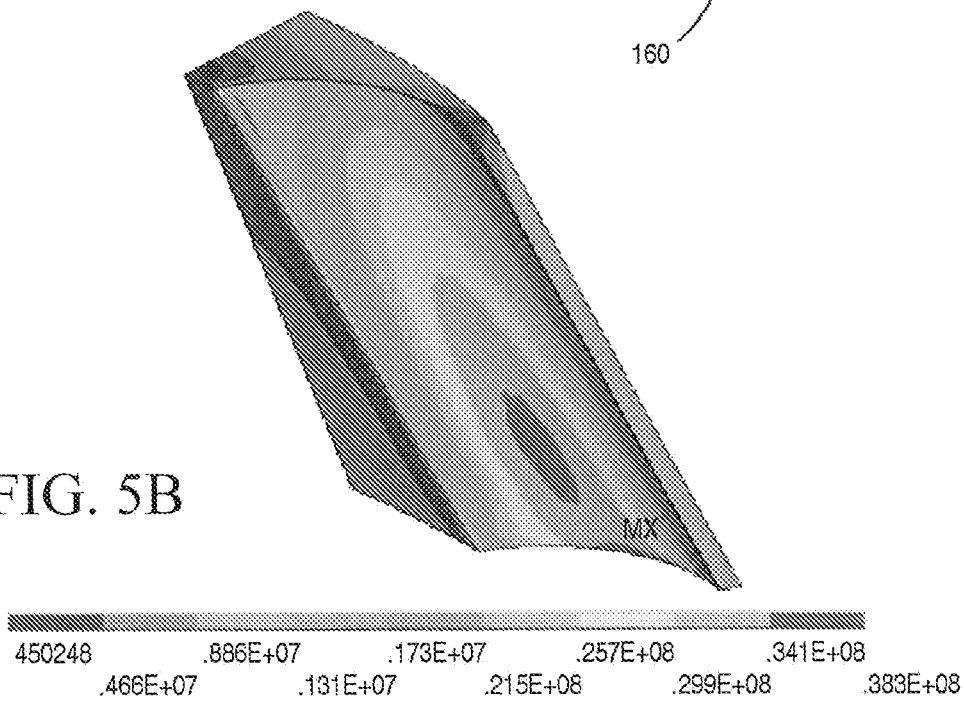
Figure 7:
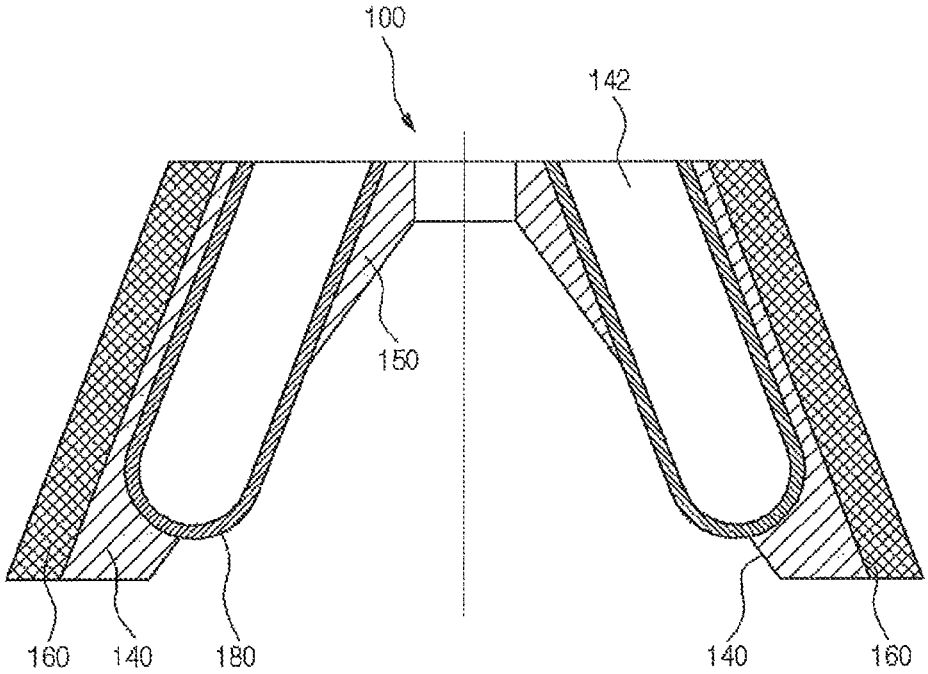
FIG. 7 is a vertical sectional view of a centrifuge rotor according to a first embodiment of the present invention.

The present invention provides a fixed angle hybrid centrifuge rotor 100, in FIG. 7, having a reinforcer 180 which penetrates and downwardly protrudes from an inner portion 140 as shown in FIGS. 3 and 5, while a conventional fixed angle hybrid centrifuge rotor has a reinforcer which is surrounded by the inner portion 140 and does not protrude from the inner portion (refer to FIGS. 2 and 4).

Figure 6:
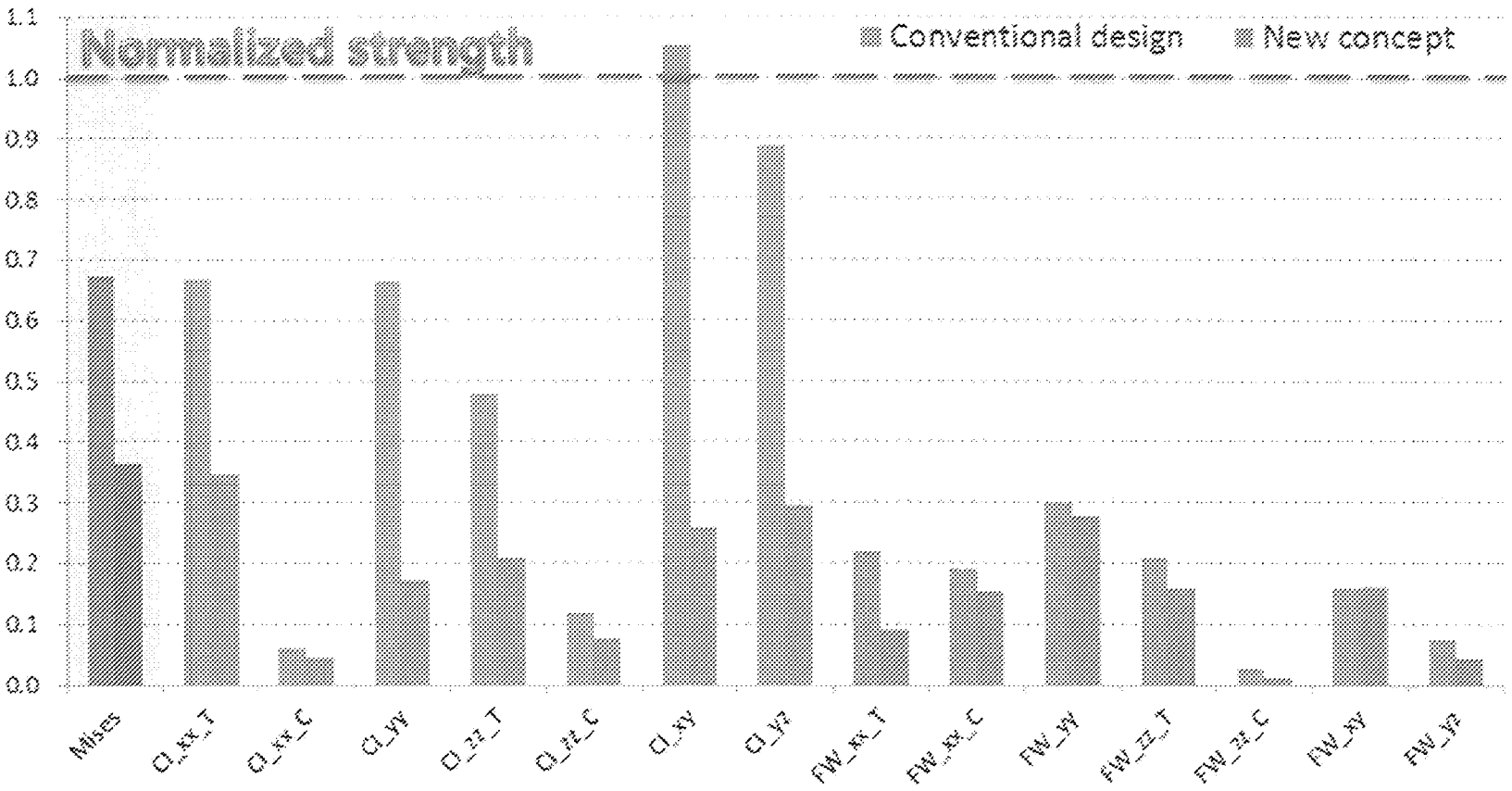
FIG. 6 is a graph showing ratios of stress relative to strength in each part of the rotors, which are obtained from the results obtained in FIGS. 4 and 5.

When the structure shown in FIG. 2 changes to the structure shown in FIG. 3, the maximum Von Mises stress generated in an isotropic inner portion decreases by about 40%. FIG. 6 shows the results of three dimensional stress analysis in which slanting of portions constituting the rotor 100 as shown in FIGS. 4 and 5 is taken into consideration.

In FIG. 6, Mises, CI and FW represent Von Mises stress in the inner portion, the reinforcer of composite material and an outer portion of composite material 160, in FIG. 7, respectively. Also, x, y and z, T and C represent fiber orientation, vertical directions to the fiber orientation, tensile stress and compressive stress respectively.

If a position where the maximum centrifugal force is generated is 40 mm from a rotational axis and the number of revolution is 100,000 rpm, in the case of the conventional structure where the inner portion completely surrounds the reinforcer, the reinforcer of composite material in which shear stress is generated is a weak part, and the shear stress equals to 1.05 times the value of shear strength. However, in the case of the structure of the present invention where the reinforcer protruded from the inner portion, the inner portion in which Von Mises stress is generated is a weak part, and the Von Mises stress equals to 0.35 times the value of failure strength.

The above result means a safety factor of the structure of the present invention increases by three-fold compared to that of the conventional structure. In other words, the structure of the present invention may generate a three-fold higher centrifugal force than that of the conventional structure.

A physical interpretation regarding the structure shown in FIG. 4 is as follows; The outer portion of composite material reinforced with fiber along its peripheral direction serves to suppress the overall expansion of the structure due to the centrifugal force. Even though the inner portion having lower stiffness than that of the outer portion has to expand due to the centrifugal force, its expansion is suppressed by the outer portion of composite material. This causes the inner portion be in a compressive stress state.

A specimen mounted into the reinforcer of composite material exerts a force along the radial direction by the centrifugal force, and the reinforcer bearing the force transfers the force by compressing the inner portion along the radial direction. That is, among interfaces between the reinforcer and the inner portion, compressive stress is generated in an interface placing near the outer portion and tensile stress is generated in an interface placing near the rotational axis. A structural weak part of the structure shown in FIG. 4 is the interface where the tensile stress is generated. Therefore, the concept of the present invention is to suppress the generation of the tensile stress by removing functionally unnecessary parts of the inner portion and to decrease the overall stress in the structure.

In the point of view of function, the featuring elements of the present invention are the outer portion 160 fabricated from composite material in order to suppress the expansion of the overall structure, the inner portion 140 having stiffness less than ⅕ of stiffness of the outer portion in order to generate compressive stress in the outer portion 160 along the radial direction, a plurality of slots 142 receiving specimens to be centrifugally separated, the reinforcer of composite material 180 penetrating the inner portion, and a connecting portion 150 connecting a driving shaft and the rotor in order to drive the rotor.

Referring to FIG. 7, the fixed angle hybrid centrifuge rotor 100 of the present invention is now described.

FIG. 7 shows a sectional view of a first embodiment of the centrifuge rotor 100 according to the present invention.

As shown, the centrifuge rotor 100 comprises the outer portion of composite material 160 reinforced with fiber at least along the peripheral direction, the inner portion 140 having stiffness less than ⅕ of stiffness of the outer portion and being radially provided with the slots and being provided with the connecting portion 150 which is connected with the driving shaft and placed in a center of rotation, and the reinforcer of composite material 180 penetrating and downwardly protruding from the inner portion 140.

The inner portion 140 is radially provided with the slots 142 receiving the specimens which are made by perforating or forming. The slots 142 are made to be externally slanted in order to prevent the specimens from leaving from the slots by the centrifugal force, when rotating at a high speed.

The inner portion 140 is preferably fabricated from material having stiffness less than ⅕ of stiffness of the outer portion, for example, polymer. The reason is described below.

The outer portion 160 is placed at the outer side of the inner portion 140 and fabricated from composite material reinforced with fiber which has much higher strength and lower density than metals. Though the fiber is arranged mainly along the peripheral direction, the fiber arrangement may be varied within ±45 degrees toward z-direction, that is, an axial direction, from the peripheral direction.

Strength of composite materials along the fiber orientation is generally much higher than metals, but strength along the vertical directions relative to the fiber orientation is typically less than 1/30 of the fiber orientation' strength. Conventional fixed angle hybrid centrifuge rotors employing the composite materials usually have a stress ratio (=stress along the radial direction/stress along the peripheral direction, when the rotor rotates) of 10 or less. Therefore, normally, failure of the composite materials first happens along the radial direction, that is, a vertical direction relative to the fiber orientation.

When elastic analysis and finite element analysis about high speed rotation of anisotropic hybrid materials having the inner portion 140 and the outer portion 160 were performed, it was found that a factor affecting the stress ratio is a stiffness ratio, that is, an elastic modulus ratio between the inner portion 140 and the outer portion 160 and, in a normal size centrifuge rotor, when stiffness of the inner portion 140 is less than ⅕ of stiffness of the outer portion 160, the fiber orientation' strength may be fully exploited.

Therefore, it is preferable that, after filament or fiber is many times wound around the outer surface of the inner portion 140, then the outer portion 160 is formed by injecting and curing polymer, or after filament or fiber impregnated with polymer is many times wound around the outer surface of the inner portion 140, then the outer portion 160 is formed by curing. Also, it is preferable that the outer portion 160 is formed as composite material by RTM (resin transfer molding), or formed by winding composite material of a B-stage around the outer surface of the inner portion 140. Also, the outer portion 160 may be attached to the inner portion 140 by an adhesive.

If the stiffness of the inner portion 140 becomes lower, during rotation, the expansion of the inner portion 140 becomes easy compared with the expansion of the outer portion 160 and the inner portion 140 presses the outer portion 160. In the process of such pressing, compressive stress is generated at the interface between the inner portion 140 and the outer portion 160. The compressive stress suppresses delamination of the interface and crack propagation.

From the above description, it may be understood that, in order to design the rotor 100 fully exploiting the maximum strength of the outer portion 160, the outer portion 160 needs to be reinforced with fiber along the peripheral direction (θ) so that it may bear much higher stress and the inner portion 140 needs to be made of materials having stiffness less than ⅕ of stiffness of the outer portion 160 along the peripheral direction so that each stress along the radial and peripheral directions of the inner portion 140 having relatively low strength and along the radial direction of the outer portion 160 may become low.

Figure 1A:
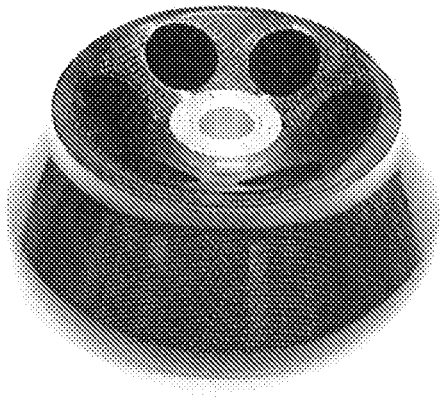
FIGS. 1A-1C are a perspective view of a fixed angle centrifuge rotor and graphs showing stress concentrations generated around a slot of a conventional fixed angle centrifuge rotor.
Figure 1B:
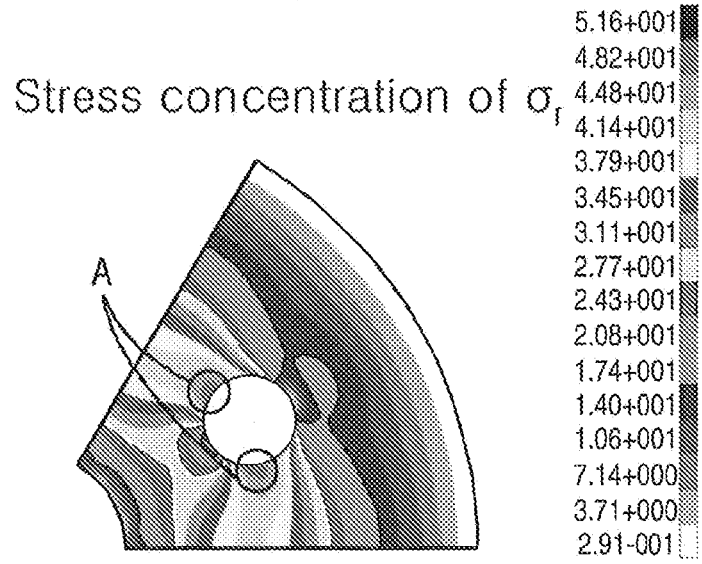
Figure 1C:
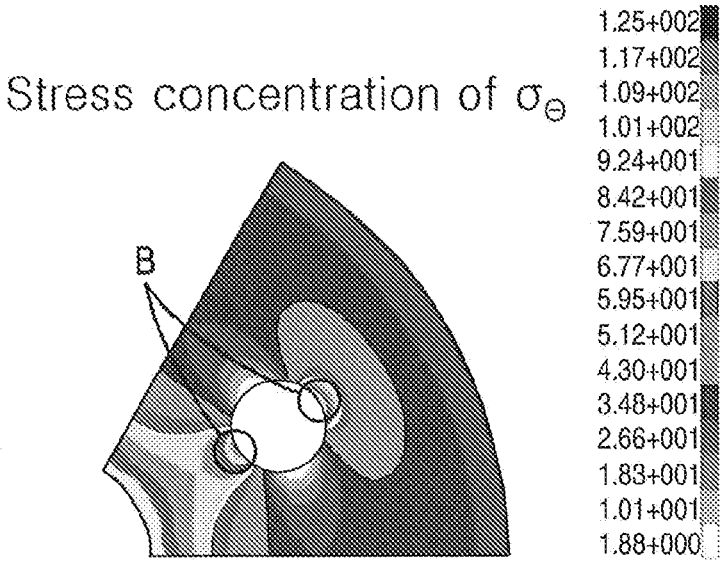

Therefore, it is preferable that the inner portion 140 is fabricated from material having lower stiffness than that of the outer portion 160. For example, composite materials and polymer may be employed in the outer portion 160 and the inner portion 140 respectively. According to the stiffness of the outer portion 160, various materials other than polymer may be applied to the inner portion 140. For example, as shown in FIG. 1, when composite material above URN 300 grade which has stiffness of 370 GPa along the fiber orientation is employed in the outer portion 160, aluminum alloys, magnesium alloys, etc. which have stiffness of 70 GPa or less, in other words, stiffness less than ⅕ of stiffness of the composite material may be employed in the inner portion 140.

Since various materials may be employed in the inner portion 140, the inner portion 140 may be fabricated by machining or various kind of forming based on the property of the employed material.

The inner portion 140 is provided with a plurality of reinforcers 180 fabricated from composite material. The reinforcer 180 is hollow and open at the upper side so as to receive the specimen. The closed lower side of the reinforcer 180 protrudes from the inner portion 140 toward the lower side.

The inner portion 140 is provided with a plurality of slots 142, which penetrate the inner portion and are radially slanted. The reinforcer 180 is mounted into the slot 142 and, in a state of mounting, the outer surface of the reinforcer's lower side protrudes from the slot 142 and is exposed to the air.

Such exposure of only a portion of the reinforcer 180, or the outer surface of the reinforcer's lower side, may cause stress concentration to decrease sufficiently. The reason is described below.

From elastic analysis of a rotating body, it may be understood that stress is proportional to the square of the radius. When the rotor 100 rotates, the maximum stress is generated at a place of the max diameter. Stress in the upper part having a relatively small diameter decreases. The amount of decrease is also proportional to the square of the radius. Therefore, even though the reinforcer 180 is exposed only at the lower end part of the rotor where the max stress is generated, it can have a sufficient effect on the decrease of stress concentration.

The reinforcer 180 of composite material may be formed by RTM (resin transfer molding), resin infusion, or filament winding, etc. The reinforcer 180 may be forcefully inserted into the slot 142 or glued to the inside of the slot 142 by a adhesive.

When designing the inner portion 140 and the outer portion 160, stiffness of the inner portion 140 is controlled so as to be less than ⅕ of stiffness of the outer portion 160. In other words, polymer and composite material are employed in the inner portion 140 and the outer portion 160 respectively. When composite material above URN 300 grade which has stiffness of 370 GPa along the fiber orientation is employed in the outer portion 160, aluminum alloys, magnesium alloys, etc. which have stiffness of 70 GPa or less may be employed in the inner portion 140.

Figure 8:
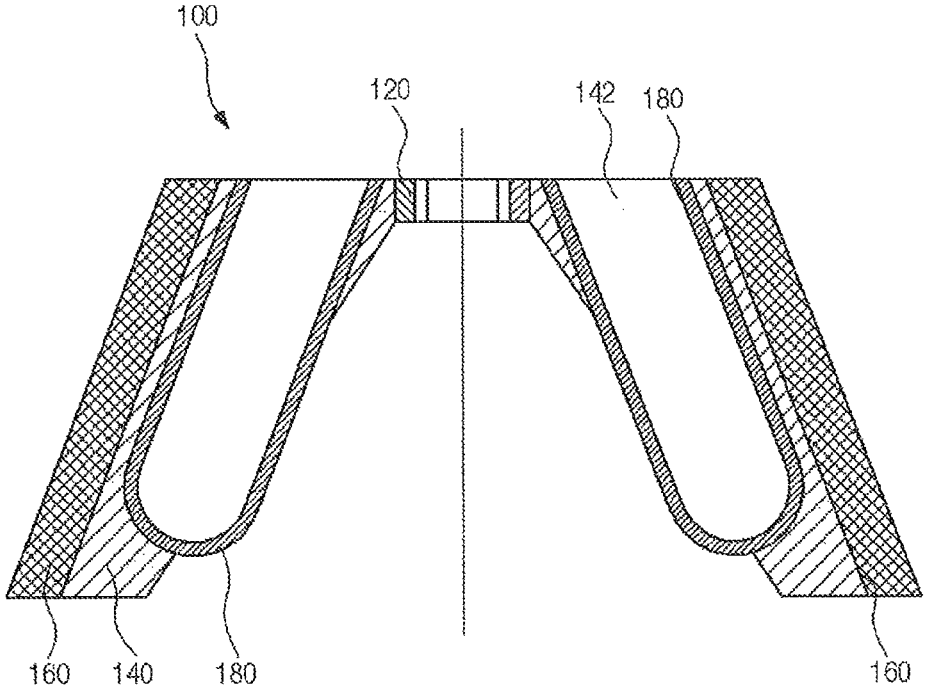
FIG. 8 is a vertical sectional view of a centrifuge rotor according to a second embodiment of the present invention.

Referring to FIG. 8, a centrifuge rotor according to a second embodiment of the present invention is described.

In the case of the rotor 100 in which the radius of the connection portion 150 connected to the driving shaft is small, the centrifuge rotor 100 of the first embodiment as shown in FIG. 7 does not show the problem that spacing from the driving shaft widens. However, In the case of the rotor 100 in which the radius of the connection portion 150 connected to the driving shaft is large and the inner portion 140 having low stiffness is employed, the problem of widened spacing happens, since the expansion of the inner diameter of the connecting portion 150 is large during rotation.

The centrifuge rotor of the second embodiment solves the problem of widened spacing by including a hub 120 in the centrifuge rotor of the first embodiment. As shown in FIG. 8, the hub 120 is forcefully mounted into the inside part of the inner portion 140 such that it pressures the inner portion in a state of mounting. The hub 120 serves as a kind of central shaft rotating the rotor 100 by receiving driving power from a motor (not shown). The hub 120 is fabricated from a material having higher stiffness than that of the inner portion 140 and its shape is based on a hollow circular cylinder. In other words, while the hub 120 may be, as shown in FIG. 8, shaped as just a hollow circular cylinder, if necessary, the hollow circular cylinder may be provided with a flange or a rib, etc.

In order to prevent a gap between the inner portion 140 and the hub 120 from occurring during high speed rotation, when the hub 120 is forcefully mounted into the inner portion 140, the amount of expansion of the inner diameter of the inner portion 140 expected at a targeted number of rotation in use is taken into consideration.

For example, the forceful mounting between the hub 120 and the inner portion 140 may be achieved by utilizing thermal expansion. The hub 120 is such fabricated that the outer diameter of the hub 120 is larger than the inner diameter of the inner portion 140 by the expected amount of expansion of the inner diameter of the inner portion 140. The hub 120 is thermally contracted by cooling and the inner portion 140 is thermally expanded by heating. Since the outer diameter of the hub 120 becomes larger than the inner diameter of the inner portion 140 under such thermally expanded and contracted states, the hub can be easily inserted into the inner portion. When the hub 120 and the inner portion 140 reach a equal temperature state after the insertion, a pressure is generated. That is, the hub 120 expands and the inner portion 140 contracts after the insertion and, therefore, the hub 120 is mounted into the inner portion 140 with a state of pressuring the inner portion.

Also, when hub 120 is mounted into the inner portion 140, the rotor 100 of the present invention is designed to generate such a state of pressuring the inner portion. In other words, each tolerance of the hub 120 and the inner portion 140 is controlled as positive (+) and minus (−) respectively such that the overall tolerance equals to the expected amount of expansion of the inner diameter of the inner portion 140. Therefore, as described above, when the hub 120 and the inner portion 140 are connected, they may be forcefully connected each other by utilizing a volume change due to a temperature difference.

Figure 9:
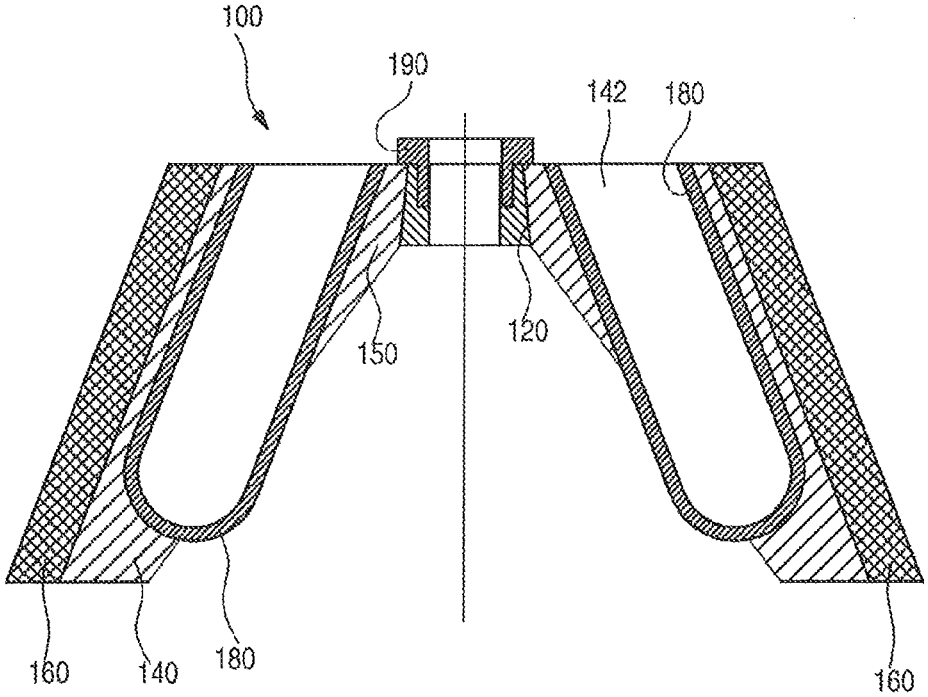
FIG. 9 is a vertical sectional view of a centrifuge rotor according to a third embodiment of the present invention.

Referring to FIG. 9, a centrifuge rotor according to a third embodiment of the present invention is described FIG. 9 shows a variation of the hub 120 shown in the second embodiment. The hub shown in FIG. 8 is intended for generating compressive stress at the interface between the inner portion 140 and the hub 120. A hub 120 shown in FIG. 9 achieves such intention by a shape of a truncated hollow cone obtained by perforating its center and slanting its outer surface. After the hub 120 is forcefully inserted into the inner portion 140, it continuously pressures the inner portion 140 after its insertion, which is the same state described in the second embodiment. As a result, even though the inner portion 140 outwardly deforms due to high speed rotation, such pressuring by the hub 120 suppresses the deformation to be generated in the inner portion 140.

Also, if necessary, the hub 120 may be provided with a connecting member 190 such as a flange or a rib, etc. which helps the hub 120 be mounted into the inner portion 140 with a state of pressuring the inner portion. In other words, the lower part of the connecting member 190 is threadedly engaged with the upper part of the hub 120 at the upper side of the hub 120. Therefore, in a state of such engagement, the connection member 190 makes the hub 120 be tightly mounted into the inner portion 140 with a state of pressuring the inner portion.

Figure 10:
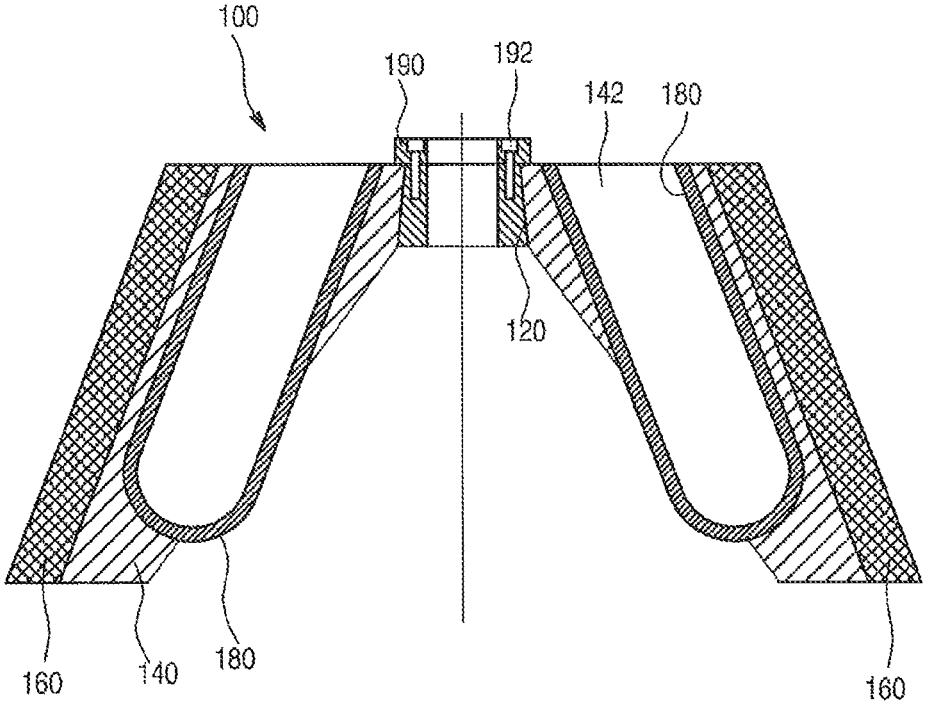
FIG. 10 is a vertical sectional view of a centrifuge rotor according to a fourth embodiment of the present invention.

Now, referring to FIG. 10, a centrifuge rotor according to a fourth embodiment of the present invention is described.

The fourth embodiment shows a variation in engagement of the hub 120 and the connecting member 190 as shown in the third embodiment. As shown in FIG. 10, the connecting member 190 is provided with a mounting member 192, which penetrates the connecting member 190. The mounting member 192 is threadedly engaged with the connecting member 190 at the upper side of the connecting member. Such engagement serves to push the hub 120 upwardly and, as well, assist pressuring the inner portion 140 by the hub.

Figure 11:
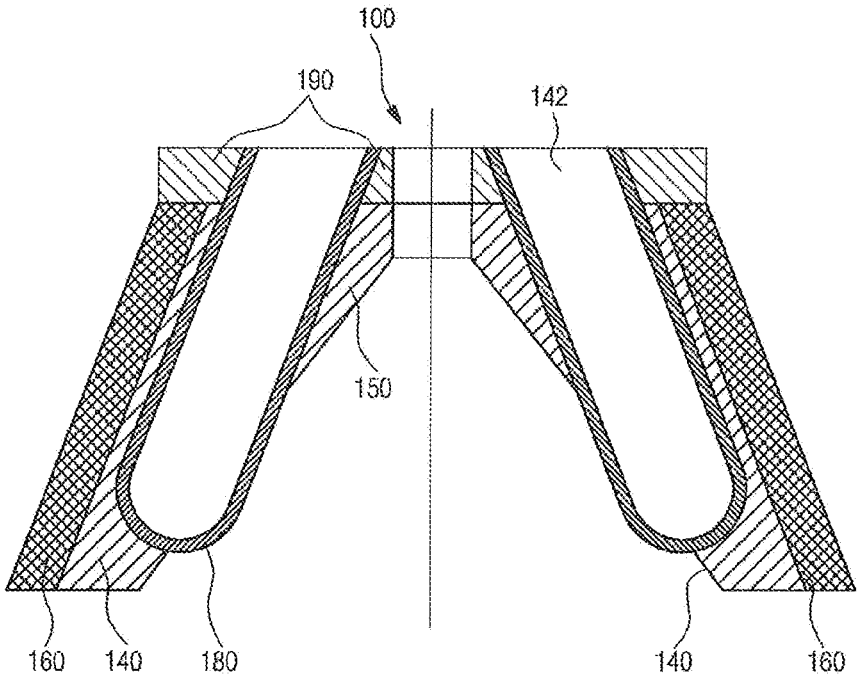
FIG. 11 is a vertical sectional view of a centrifuge rotor according to a fifth embodiment of the present invention.

Now, referring to FIG. 11, a centrifuge rotor according to a fifth embodiment of the present invention is described.

Instead of utilizing the compressive stress generated between the hub 120 and the inner portion 140 as shown in the second to fourth embodiments, the fifth embodiment shown in FIG. 11 suppresses the expansion of the inner diameter of the connecting portion 150 during high speed rotation by employing a connecting member 190, which has higher stiffness than that of the inner portion 120 and is glued to least the upper part of the inner portion 140 using an adhesive.

Figure 12:
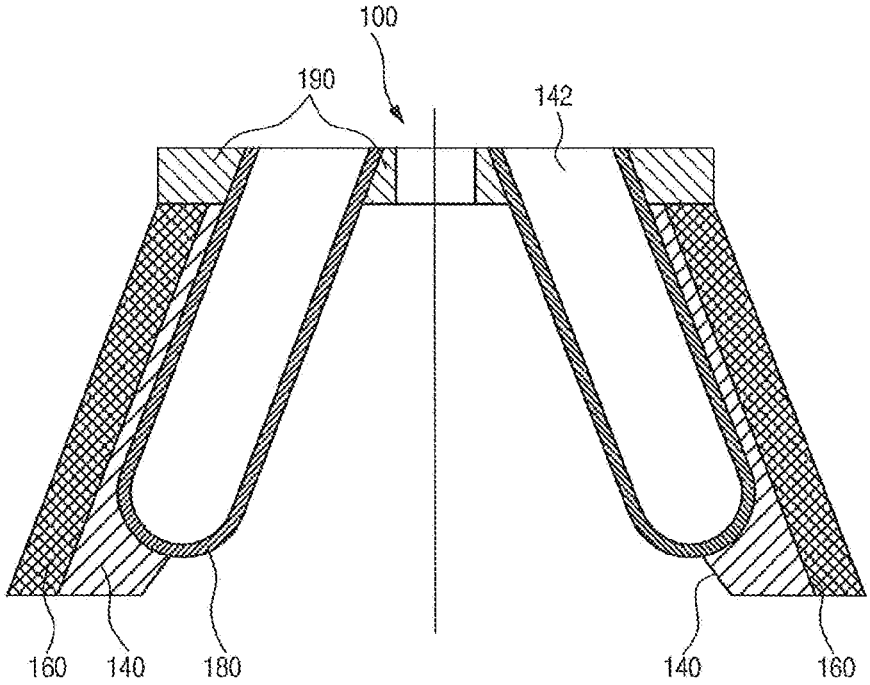
FIG. 12 is a vertical sectional view of a centrifuge rotor according to a sixth embodiment of the present invention.

Now, referring to FIG. 12, a centrifuge rotor according to a sixth embodiment of the present invention is described.

The sixth embodiment shows a structure that the part of the reinforcer 180 exposed to the air is enlarged to the upper end part of the rotor by totally removing a functionally unnecessary part of the inner portion 140 which is placed at the inside of the reinforcer 180. Such a structure has higher structural efficiency due to enlargement of the part of the reinforcer 180 exposed to the air, and highly improves the problem of the expansion of the inner diameter, since the driving shaft is connected with only the connecting member 190 having higher stiffness than that of the inner portion 140.

Figure 13:
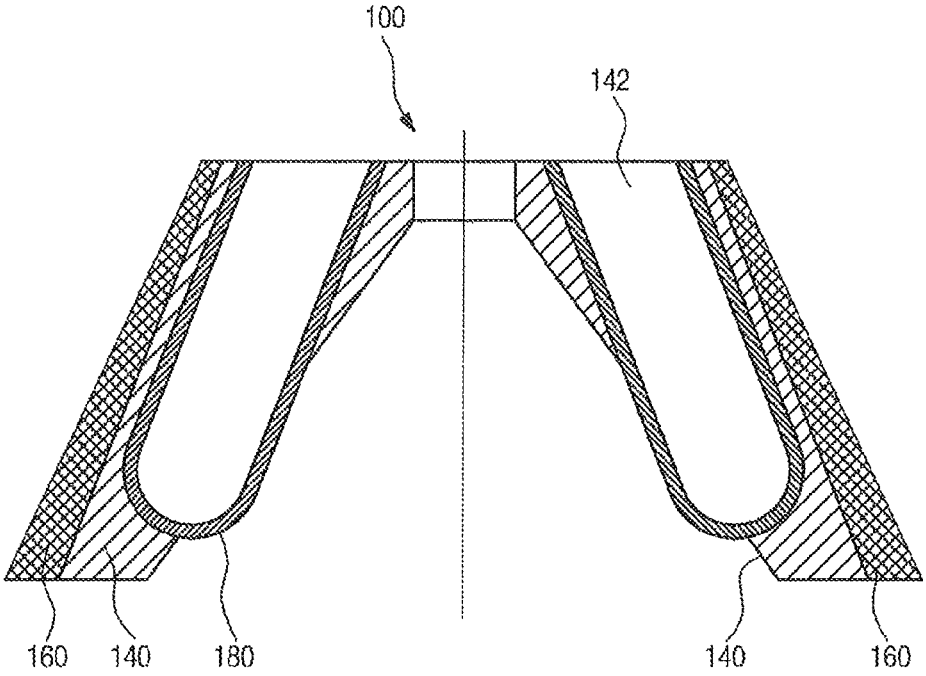
FIG. 13 is a vertical sectional view of a centrifuge rotor according to a seventh embodiment of the present invention.

Finally, referring to FIG. 13, a centrifuge rotor according to a seventh embodiment of the present invention is described.

The seventh embodiment is a variation of the first embodiment and shows a structure that the thickness of the upper end part of the outer portion 160 reinforced with fiber along at least the peripheral direction is smaller than that of the outer portion's lower end part in order to further increase structural efficiency.

According to elastic theory, a thickness ratio between the inner portion 140 and the outer portion 160 showing the maximum structural efficiency is proportional to the radius of the overall structure. Therefore, in the point of view of structural efficiency, the thickness of the outer portion 160 is optimized when the lower end part of the outer portion having a larger radius is thicker than the upper end part of the outer portion having a smaller radius. As a result, the rotor 100 having the outer portion 160 where the lower end part of the rotor is thicker than the upper end part, as shown in FIG. 13, has highly increased structural efficiency and, therefore, may generate a much higher centrifugal force.

The foregoing discussion discloses and describes merely exemplary embodiments of the present invention. As will be understood by those familiar with the art, the invention may be embodied in other variations without departing from the spirit or essential characteristics thereof.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A fixed angle hybrid centrifuge rotor comprising:

an outer portion of composite material reinforced with fiber at least along a peripheral direction, an inner portion having a stiffness less than ⅕ of a stiffness of the outer portion and being provided with a plurality of slots configured to receive specimens, and a reinforcer of composite material which is mounted into the slots of the inner portion, the reinforcer being fabricated from material having a higher stiffness than that of the inner portion and reinforced with fiber along at least peripheral direction of the slot, wherein only an inside portion of the reinforcer penetrates the inner portion and at least a part of the inside portion of the reinforcer downwardly protrudes from the inner portion.

2. A fixed angle hybrid centrifuge rotor comprising:

an outer portion of composite material reinforced with fiber at least along a peripheral direction, an inner portion having a stiffness less than ⅕ of a stiffness of the outer portion and being provided with a plurality of slots configured to receive specimens, a hub having a higher stiffness than that of the inner part and an external diameter larger than the inner diameter of the inner portion, wherein the hub is mounted into the inner portion such that it pressures the inner portion from the inside of the inner portion in a state of mounting, and a reinforcer of composite material which is mounted into the slots of the inner portion, the reinforcer being fabricated from material having a higher stiffness than that of the inner portion and reinforced with fiber along at least peripheral direction of the slot, wherein only an inside portion of the reinforcer penetrates the inner portion and at least a part of the inside portion of the reinforcer downwardly protrudes from the inner portion.

3. A fixed angle hybrid centrifuge rotor comprising:

an outer portion of composite material reinforced with fiber at least along a peripheral direction, an inner portion having stiffness a less than ⅕ of a stiffness of the outer portion and being provided with a plurality of slots configured to receive specimens, a hub having a higher stiffness than that of the inner part and an external diameter larger than the inner diameter of the inner portion, wherein the hub is mounted into the inner portion such that it pressures the inner portion from the inside of the inner portion in a state of mounting, a connecting member connected into one side of the hub and configured to cause the hub to pressure the inner portion in a state of connection, and a reinforcer of composite material which is mounted into the slots of the inner portion, the reinforcer being fabricated from material having a higher stiffness than that of the inner portion and reinforced with fiber along at least peripheral direction of the slot, wherein only an inside portion of the reinforcer penetrates the inner portion and at least a part of the inside portion of the reinforcer downwardly protrudes from the inner portion.

4. A fixed angle hybrid centrifuge rotor comprising:

an outer portion of composite material reinforced with fiber at least along a peripheral direction, an inner portion having a stiffness less than ⅕ of a stiffness of the outer portion and being provided with a plurality of slots configured to receive specimens, a connecting portion having higher a stiffness than that of the inner portion, wherein the connecting portion is mounted on at least an upper part of the inner portion and configured to connect to a driving shaft, and includes openings connected with the slots of the inner portion, and a reinforcer of composite material which is mounted into the slots of the inner portion, the reinforcer being fabricated from material having a higher stiffness than that of the inner portion and reinforced with fiber along at least peripheral direction of the slot, wherein only an inside portion of the reinforcer penetrates the inner portion and at least a part of the inside portion of the reinforcer downwardly protrudes from the inner portion.

5. A fixed angle hybrid centrifuge rotor according to claim 1, wherein the farther the outer portion's distance from a center of rotation is, the thicker the outer portion becomes.

6. A fixed angle hybrid centrifuge rotor according to claim 2, wherein the hub is shaped as a truncated hollow circular cone.

7. A fixed angle hybrid centrifuge rotor according to claim 1, wherein the inner diameter of the outer portion is smaller than the outer diameter of the inner portion and, therefore, the inner portion is forcefully inserted into the outer portion.

8. A fixed angle hybrid centrifuge rotor according to claim 1, wherein, after filament or fiber is many times wound around the outer surface of the inner portion, the outer portion is formed by injecting and curing polymer.

9. A fixed angle hybrid centrifuge rotor according to claim 1, wherein, after filament or fiber impregnated with polymer is many times wound around the outer surface of the inner portion, the outer portion is formed by curing.

10. A fixed angle hybrid centrifuge rotor according to claim 1, wherein, after composite material at a B-stage is wound around the outer surface of the inner portion, the outer portion is formed by curing.

11. A fixed angle hybrid centrifuge rotor according to claim 1, wherein the outer portion is connected with the inner portion by an adhesive.

12. A fixed angle hybrid centrifuge rotor according to claim 1, wherein the reinforcer is formed as composite material by TRM (resin transfer molding).

13. A fixed angle hybrid centrifuge rotor according to claim 1, wherein the reinforcer is mounted into the slots by forcefully inserting or gluing using an adhesive.

14. A fixed angle hybrid centrifuge rotor according to claim 2, wherein the farther the outer portion's distance from a center of rotation is, the thicker the outer portion becomes.

15. A fixed angle hybrid centrifuge rotor according to claim 3, wherein the farther the outer portion's distance from a center of rotation is, the thicker the outer portion becomes.

16. A fixed angle hybrid centrifuge rotor according to claim 4, wherein the farther the outer portion's distance from a center of rotation is, the thicker the outer portion becomes.

17. A fixed angle hybrid centrifuge rotor according to claim 3, wherein the hub is shaped as a truncated hollow circular cone.

18. A fixed angle hybrid centrifuge rotor according to claim 2, wherein the inner diameter of the outer portion is smaller than the outer diameter of the inner portion and, therefore, the inner portion is forcefully inserted into the outer portion.

19. A fixed angle hybrid centrifuge rotor according to claim 3, wherein the inner diameter of the outer portion is smaller than the outer diameter of the inner portion and, therefore, the inner portion is forcefully inserted into the outer portion.

20. A fixed angle hybrid centrifuge rotor according to claim 1, wherein an entire inside portion of the reinforcer downwardly protrudes from the inner portion and is exposed to air.

* * * * *